US005953843A

United States Patent [19]

Collins et al.

[11] Patent Number: 5,953,843

[45] Date of Patent: Sep. 21, 1999

[54] INDEX TAB FOR HANGING FILE FOLDERS ADAPTED FOR AFFIXATION OF INDEX LABELS AND THE LIKE

[76] Inventors: Judy C. Collins; Eric D. Collins, both of 2 Landover Ct., Durham, N.C. 27713

[21] Appl. No.: 08/887,486

[22] Filed: Jul. 2, 1997

[51] Int. Cl.[6] ..... G09F 23/10; B24F 21/00

[52] U.S. Cl. ..... 40/641; 40/359

[58] Field of Search ..... 40/359, 360, 641; 283/41

[56] References Cited

U.S. PATENT DOCUMENTS

| | | | |
|---|---|---|---|
| 958,050 | 5/1910 | Whipple | 40/359 |
| 1,067,531 | 7/1913 | MacGregor | 40/360 |
| 1,317,265 | 9/1919 | Bushnell . | |
| 1,732,541 | 10/1929 | Sacerdote | 40/359 |
| 1,800,404 | 4/1931 | Guigley | 40/360 |
| 1,868,188 | 7/1932 | Barker . | |
| 1,927,513 | 9/1933 | Cowden | 40/360 |
| 2,021,950 | 11/1935 | Thomas | 40/360 |
| 2,307,970 | 1/1943 | Sparks | 40/360 |
| 2,420,021 | 5/1947 | Straubel et al. | 40/360 |
| 2,538,361 | 1/1951 | Furrer | 40/359 |
| 2,664,089 | 12/1953 | Meltzer | 40/359 |
| 3,386,196 | 6/1968 | Razzolini | 40/539 |
| 3,444,635 | 5/1969 | Setzler | 40/360 |
| 3,683,533 | 8/1972 | Kelly | 40/641 |
| 3,747,242 | 7/1973 | Heimann | 40/360 |
| 4,053,057 | 10/1977 | Snowden | 40/359 |
| 4,079,533 | 3/1978 | Rohner | 40/359 |
| 4,143,477 | 3/1979 | Reynolds | 40/359 |
| 4,446,183 | 5/1984 | Savagian | 428/42 |
| 4,580,815 | 4/1986 | Barber | 283/81 |
| 5,016,370 | 5/1991 | Rhian et al. | 40/641 |
| 5,135,261 | 8/1992 | Cusack et al. | 285/81 |
| 5,187,888 | 2/1993 | O'Brien et al. | 40/359 |
| 5,311,685 | 5/1994 | Wyant | 40/359 |
| 5,340,427 | 8/1994 | Cusack et al. | 156/268 |
| 5,447,334 | 9/1995 | Hartsock | 281/45 |

FOREIGN PATENT DOCUMENTS

| | | | |
|---|---|---|---|
| 1144687 | 10/1956 | Germany | 40/360 |
| 1181164 | 4/1960 | Germany | 40/359 |
| 2452296 | 11/1974 | Germany | 40/359 |
| 457014 | 6/1936 | United Kingdom | 40/360 |
| 1382715 | 7/1972 | United Kingdom | 40/360 |

*Primary Examiner*—Brian K. Green
*Assistant Examiner*—Marcus Dolce
*Attorney, Agent, or Firm*—Jenkins & Wilson, P.A.

[57] ABSTRACT

An index tab for hanging file folders that is adapted for easy affixation of self-adhesive index labels. The index tab is formed as a tab comprising sheet material having an upper portion for affixation of a self-adhesive label thereto and a lower portion adapted to be secured to a hanging file folder. The tab, in its preferred embodiment, is of a width so as to extend across substantially the entire width of a hanging file folder so that the ends thereof substantially correspond to the ends of the hanging file folder to which the tab is secured and the upper portion is angled slightly backwardly for ease of visibility.

1 Claim, 8 Drawing Sheets

INDEX TAB FOR HANGING FILE FOLDERS ADAPTED FOR AFFIXATION OF INDEX LABELS AND THE LIKE

FIELD OF THE INVENTION

The present invention relates to an improved index tab for hanging file folders, and more particularly to an improved index tab for hanging file folders that provides for easy affixation of self-adhesive index labels and the like thereto.

RELATED ART

Hanging file folders are well known to all office workers and are advantageous in that they facilitate "drop filing" which is one of the fastest methods to file a document. The use of hanging file folders is common place throughout the United States and most of the world, and hanging file folders represent a significant percentage of the overall market for products in which is to file documents. The file folder market in the United States alone is believed by applicant to be a multi-billion dollar market.

The most widely used index tab known to applicant for hanging file folders is of the type disclosed in U.S. Pat. No. 4,053,051 which discloses a file folder with a slotted top edge to receive index tabs. As known to those familiar with this art, the index tabs are typically constructed of flexible clear plastic and form a folded structure. The structure includes a message holder portion in which a paper message-carrying insert can be placed, and a base portion which includes two (2) lugs for mounting the tab into slots of the slotted file folder.

Although this type of index tab has certain advantages, the advantages are probably more than offset by the well-known disadvantages to the transparent index tab and message insert assembly. Although the conventional index tab for hanging file folders is generally provided when a consumer purchases a box of hanging file folders, the user has come to dislike this type of index tab due to the cumbersome nature of the process for using the index tab as well as the disadvantages of the index tab in ordinary use after assembly. Some of the overriding weaknesses in the conventional index tab include the following:

1. The transparent plastic insert tab and paper message carrying insert are generally disliked by office workers;
2. The index tabs are a stand-alone industry without any synergy with other related office systems; specifically there is no synergy with the label industry for the use of labels or label printing capabilities common to the office products industry;
3. The paper message carrying inserts for the index tabs must be handwritten and are therefore difficult to read, particularly for third party users of the hanging file folders;
4. The conventional index tabs discourage the usage of color to facilitate the document retrieval process since darker color inserts render readability of the paper message carrying insert more difficult whereas the index tab of the invention can be produced in multiple colors and can act as an index by the color designation itself and/or with the application of a label;
5. Conventional index tabs do not facilitate the use of label printing devices nor computers for the output of labels, nor can the conventional tabs be written on using markers or other writing devices;
6. Conventional index tabs cannot take advantage of presently available label printing and/or similar graphic based software packages for printing of file folder index parameters utilizing index parameters imported from a computer database;
7. Conventional index tabs generally lend to disorganization, poor visibility and cumbersome filing, in part because of legibility problems of many individuals writing upon the insert tab, due to misspelling, and due to the varied and random use of vernacular and descriptive titles;
8. Since the message carrying insert of the index tab is generated by individuals, it is difficult for organizations to impose standards for hanging file folder indexing; and
9. Office workers tend to grab and pull the conventional index tab when attempting to pull open a hanging file folder or to pull a hanging file folder up and out from a file cabinet, and this frequently results in the index tab being pulled off of the hanging file folder (e.g., the index tab pulls off into the office worker's hand and the hanging file folder remains behind in the file cabinet).

Thus, the applicant believes that there is a long-felt need for an improved index tab for hanging file folders that overcomes the many disadvantages associated with the conventional and widely used index tab of the type comprising a transparent plastic tab having a base portion with two (2) opposing mounting lugs and a paper message-carrying insert.

SUMMARY OF THE INVENTION

In accordance with the present invention, an index tab for hanging file folders of the type having a series of spaced -part slots adjacent the top thereof is provided wherein the index tab is particularly well adapted for easy affixation of self-adhesive labels and the like thereto. The novel index tab for hanging file folders comprises a tab formed from a sheet material and having an upper portion for affixation of a self-adhesive label thereto and a lower portion adapted to be secured to a hanging file folder. The upper portion of the tab defines a width that extends across at least ⅕ of the width of a conventional hanging file folder to which it will be secured. In this fashion, the index tab is secured to a hanging file folder and the office worker or other user then indexes the contents of the hanging file folder by applying a self-adhesive index label thereto.

It is therefore an object of the present invention to provide an improved index tab for hanging file folders.

It is another object of the present invention to provide an improved index tab for hanging file folders that is easy to removably or permanently secure to a hanging file folder.

It is another object of the present invention to provide an index tab for hanging file folders that provides for the application of indexing labels and the like.

It is another object of the present invention to provide an index tab for hanging file folders that cannot be pulled out of the hanging file folder during retrieval of the folder from a filing cabinet or the like.

Yet another object of the present invention is to provide an index tab for a hanging file folder that serves to effectively bring together hanging file folders and labels for the first time.

Some of the objects of the invention having been stated, other objects will become evident as the description proceeds, when taken in connection with the accompanying drawings described hereinbelow.

DETAILED DESCRIPTION OF THE PREFERRED EMBODIMENTS

Figure 1:
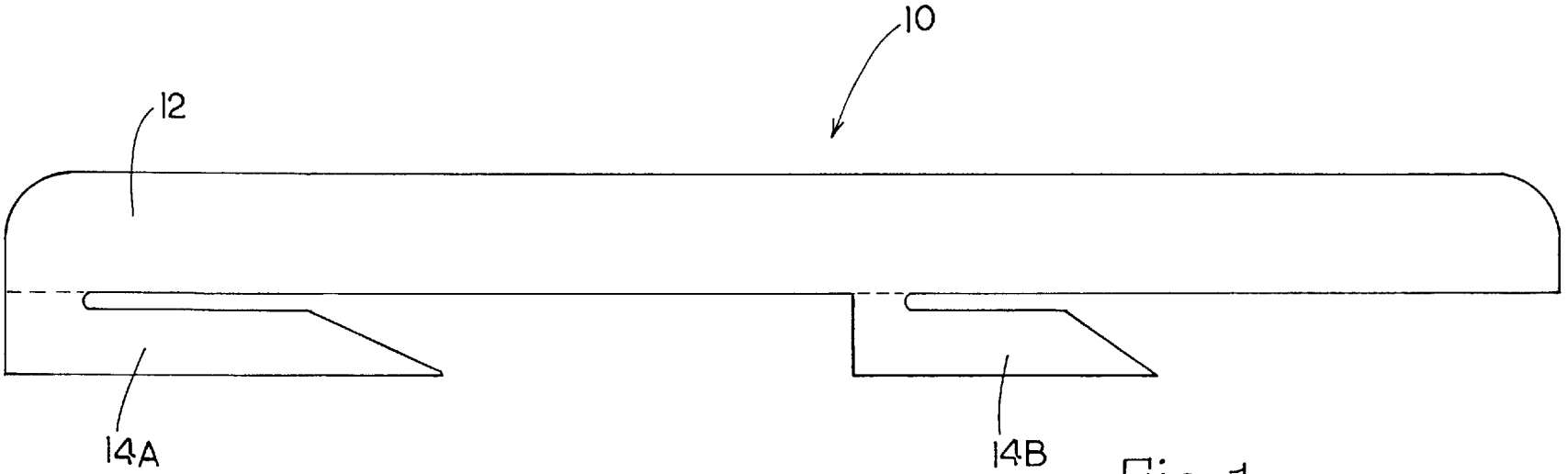
FIG. 1 is a front view of a first embodiment of the index tab of the invention.

Referring now to the drawings, an improved index tab for hanging file folders constructed in accordance with the invention is shown and generally designated 10. As seen in FIG. 1, index tab 10 includes a top portion 12 that acts as a relatively large surface area for writing upon or for affixation of a self-adhesive label L as seen in FIG. 4D. Top portion 12 is approximately ⅞" high but could be substantially any desirable height depending on the exact application or environment for which index tab 10 is being used. The standard height for top portion 12 of index tab 10 would be such that a hanging file folder with index tab 10 attached thereto would operate within a typical file drawer. Applicant further prefers that top portion 12 be of substantially the same but slightly less width than the width of a standard hanging file folder (e.g., approximately 11⅝"). However, top portion 12 of index tab 10 could be of a smaller width than a hanging file folder such as the standard ⅓ and ⅕ cut widths similar to standard top tab manila folder ⅓ and ⅕ cut tab sizes.

Index tab 10 further includes feet 14A,14B depending downwardly therefrom which each consist of a neck portion extending downwardly from top portion 12 of index tab 10 and a foot portion extending laterally outwardly from the associated neck portion. Foot 14A is located at the left end of index tab 10 with its foot portion extending laterally toward the right end of index tab 10. Foot 14B is located in the medial portion of index tab 10 with its foot portion also extending laterally toward the right end of index tab 10. Thus, feet 14A and 14B of index tab 10 can be inserted into selected existing slots S of a hanging file folder FF as will be explained hereinbelow so that top portion 12 will extend upwardly beyond the top of hanging file folder FF. In the preferred embodiment of index tab 10 as best seen in FIG. 4D, top portion 12 comprising an elongated strip extends upwardly and rearwardly from hanging file folder FF for ease of visibility and readability of index information provided on label L applied to top portion 12 of index tab 10.

Applicant contemplates that index tab 10 can be made out of many paper products such as manila, kraft or other paper/file folder grade papers or of plastic such as polyethylene, polystyrene, vinyl and the like. Although index tab 10 could extend upwardly in the plane of hanging file folder FF and be constructed of many durable paper and durable plastic products, applicant believes that the preferred embodiment of the index tab will consist of top portion 12 extending upwardly and slightly rearwardly as shown in FIG. 4D and that the index tab will be constructed of polypropylene. Further, it should be appreciated with particular reference to FIG. 1 that the foot portion of foot 14A is slightly longer than the foot portion of foot 14B for ease of insertion into corresponding slots S of hanging file folder FF as described in more detail below.

Figure 2:
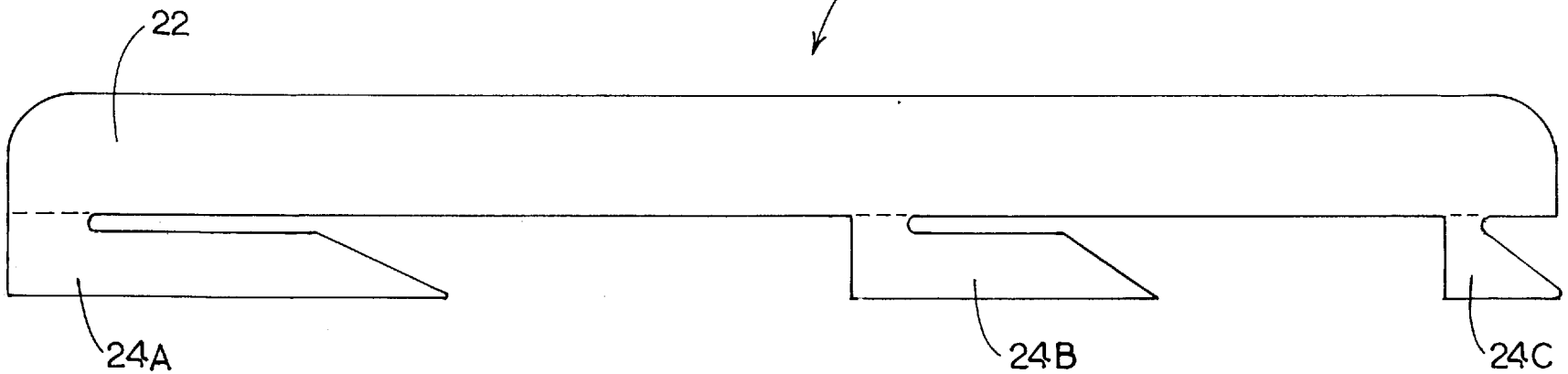
FIG. 2 is a front view of a second embodiment of the index tab of the invention.
Figure 3:
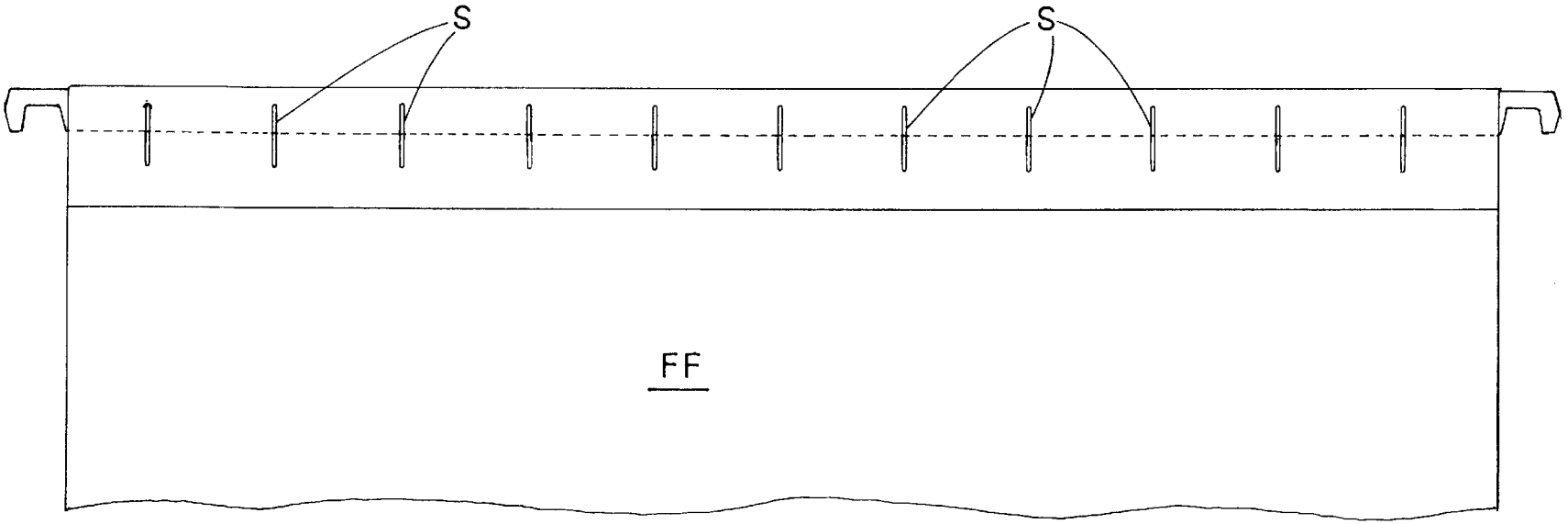
FIG. 3 is a view of the back inside wall of a hanging file folder.

In a second embodiment of the invention as shown in FIG. 2 and generally designated 20, index tab 20 includes top portion 22 and first foot 24A, second foot 24B and third foot 24C. As can be seen, first foot 24A is located at the left end of index tab 20, second foot 24B is located in the medial portion of index tab 20 and third foot 24C is located at the right end of index tab 20. Similarly to the first embodiment of the invention shown in FIG. 1, the foot portion of foot 24A is longer than the foot portion of foot 24B which is in turn longer than the front portion of foot 24C for ease of engagement by corresponding slots S in file folder FF as also discussed below.

Figure 6:
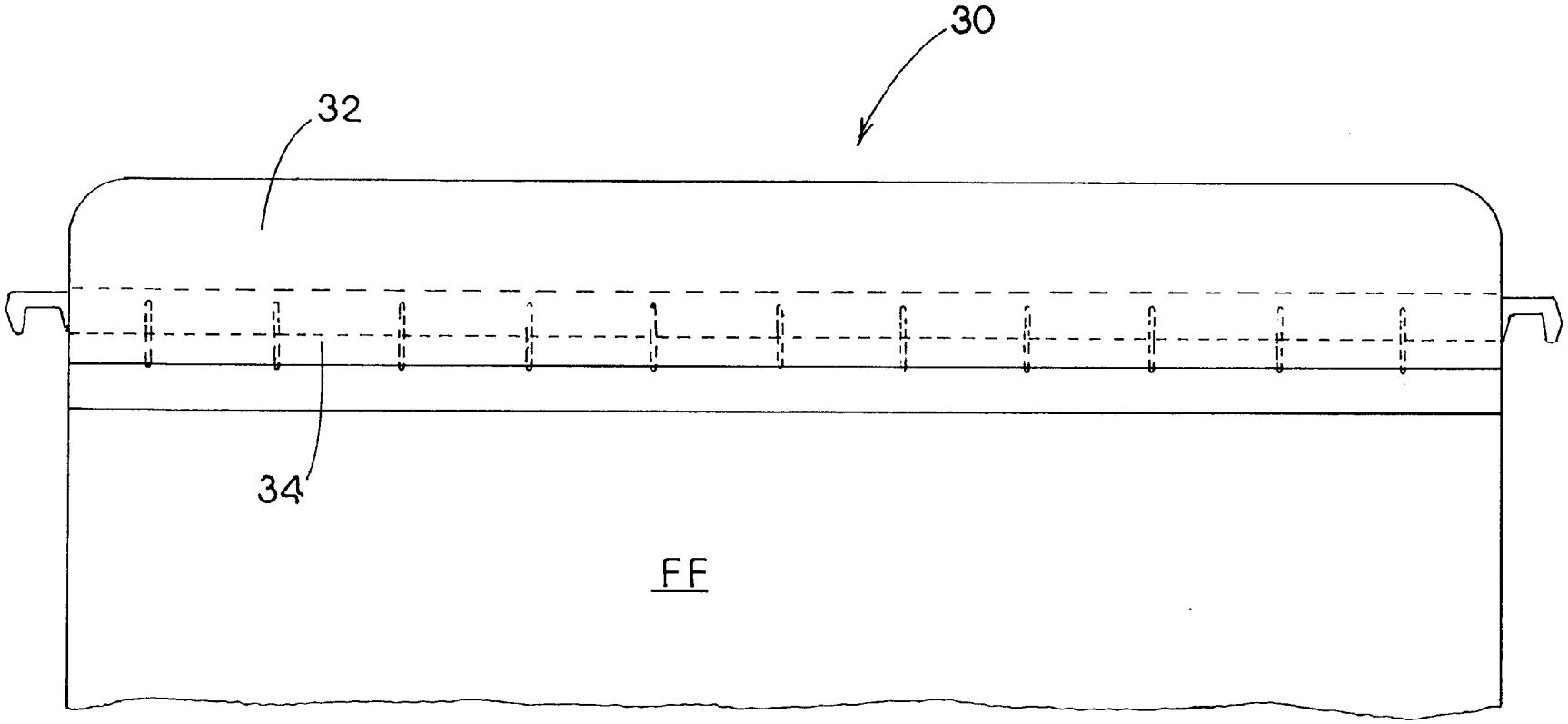
FIG. 6 is a front view of a third embodiment of the novel index tab of the invention affixed to a hanging file folder.

In a third embodiment of the invention shown in FIG. 6 and where the index tab is generally designated 30, the index tab consists of top portion 32 which serves as a vehicle for self-adhesive label L and lower portion 34 which corresponds to the feet of index tab 10 and index tab 20 embodiments of the invention. Lower portion 34 consists of a strip extending for the entire length of top portion 32 and includes a pressure-sensitive adhesive (not shown) on the back thereof so that top portion 32 can be adhesively secured along the top of hanging file folder FF as shown in FIG. 6. In this embodiment of the present invention, lower portion 34 is adhesively secured over the plurality of slots S extending across the width of file folder FF.

Figure 7:
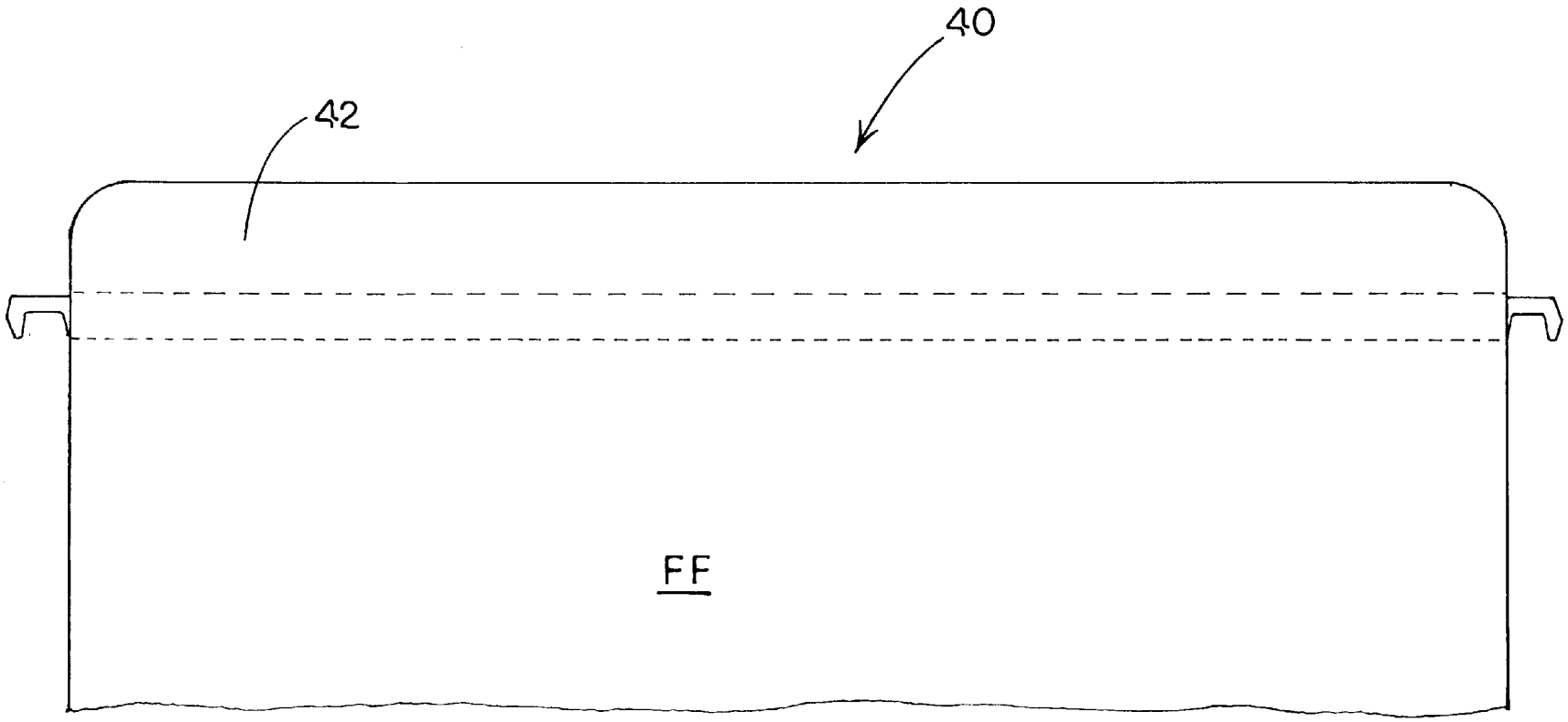
FIG. 7 is a front view of a fourth embodiment of the novel index tab of the invention wherein the index tab forms an integral part of the hanging file folder.

In a fourth embodiment of the invention as shown in FIG. 7 and generally designated 40, the novel index tab for hanging file folders consists of providing the index tab as an integral part of an otherwise conventional hanging file folder FF. Specifically, as shown in FIG. 7 the back wall of file folder FF is provided with an integral index tab 40 including top portion 42 to which self-adhesive index label L can be suitably attached. As with the preceding three (3) embodiments of the invention (e.g., index tab 10, index tab 20 and index tab 30) the top portion 42 may extend vertically upwardly in the same plane as the back wall of file folder FF or, preferably, extend upwardly and slightly rearwardly as in the preferred embodiments of index tabs 10, 20 and 30 described above.

A primary feature of all four (4) embodiments of the index tab of the present invention is that top portions 12, 22, 32 and 42 act as a vehicle for self-adhesive index label L (see FIG. 4D) for handwriting or other potential marking methods. Applicant has discovered that most users of hanging file folders FF would prefer to index the contents of hanging file folder FF with a label (e.g., self-adhesive index label L) rather than the prior art paper inserts that are typically written upon and then folded and inserted into the prior art transparent plastic index tab. Applicant contemplates that the novel index tabs of the present invention can be manufactured with indentations (not shown) in the top portion (e.g., 12, 22, 32 and 42) to allow the user to use ⅕, ⅓, ½, full width and/or other self-adhesive index label sizes. As a matter of user choice, custom or industry standard self-adhesive labels and label printing software can be used to create labels for the novel index tab of the invention. Moreover, in addition to written text, the index labels could be provided with selected images or others indicia.

Figure 4A:
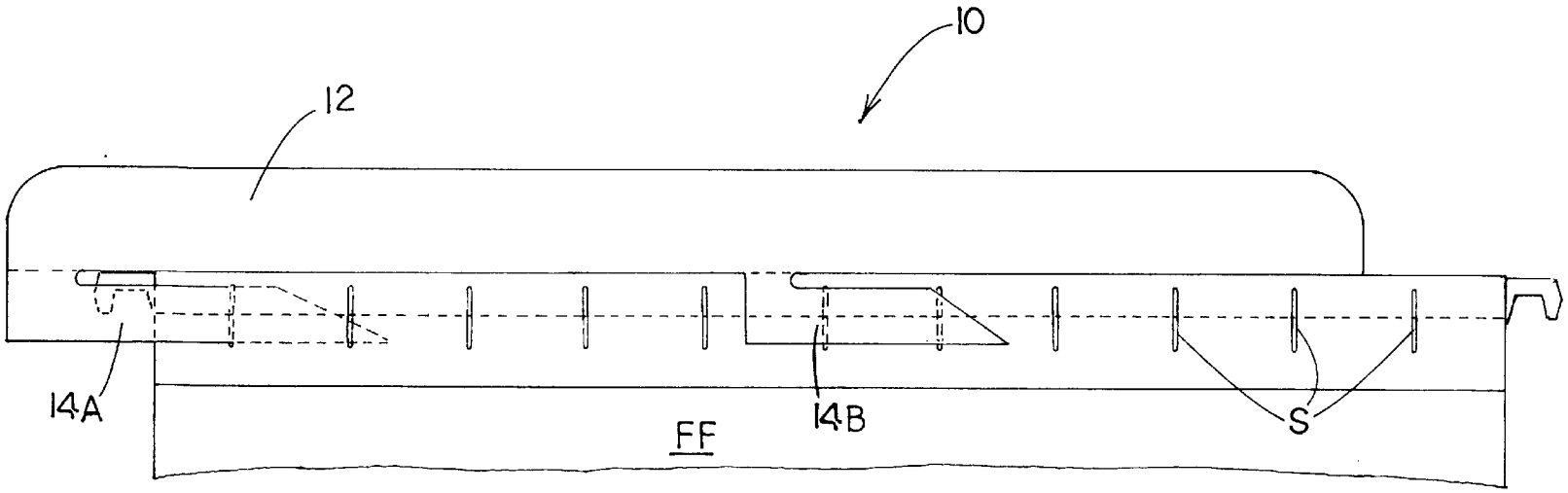
FIGS. 4A–4C are views showing the first, second and third steps, respectively, of the insertion of the index tab of FIG. 1 into the slots of a hanging file folder.
Figure 4B:
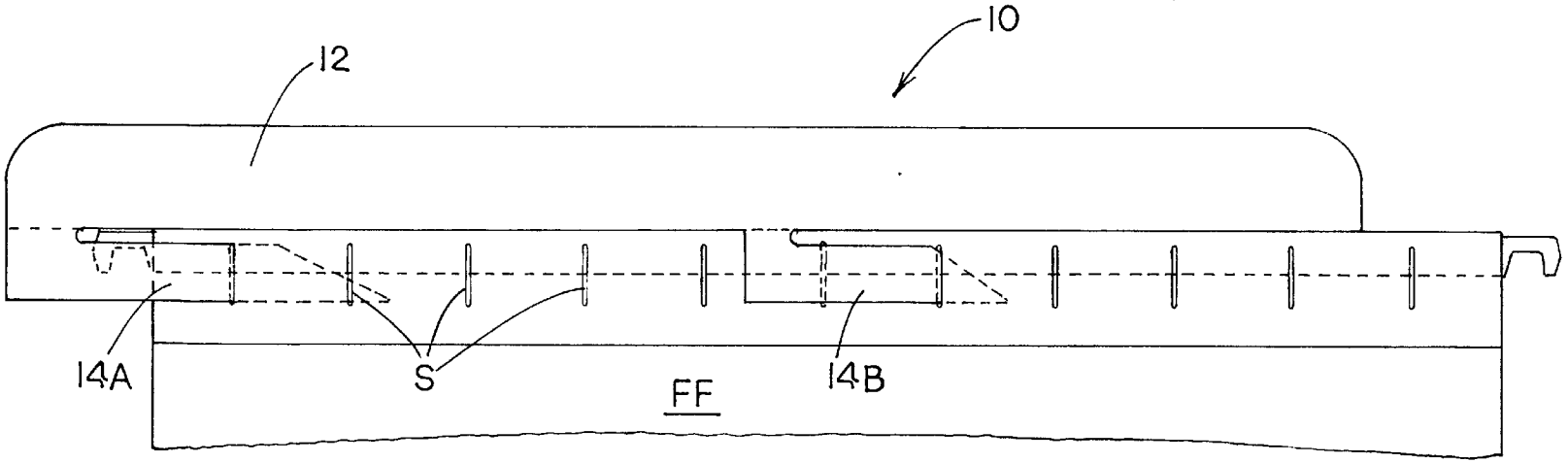
Figure 4C:
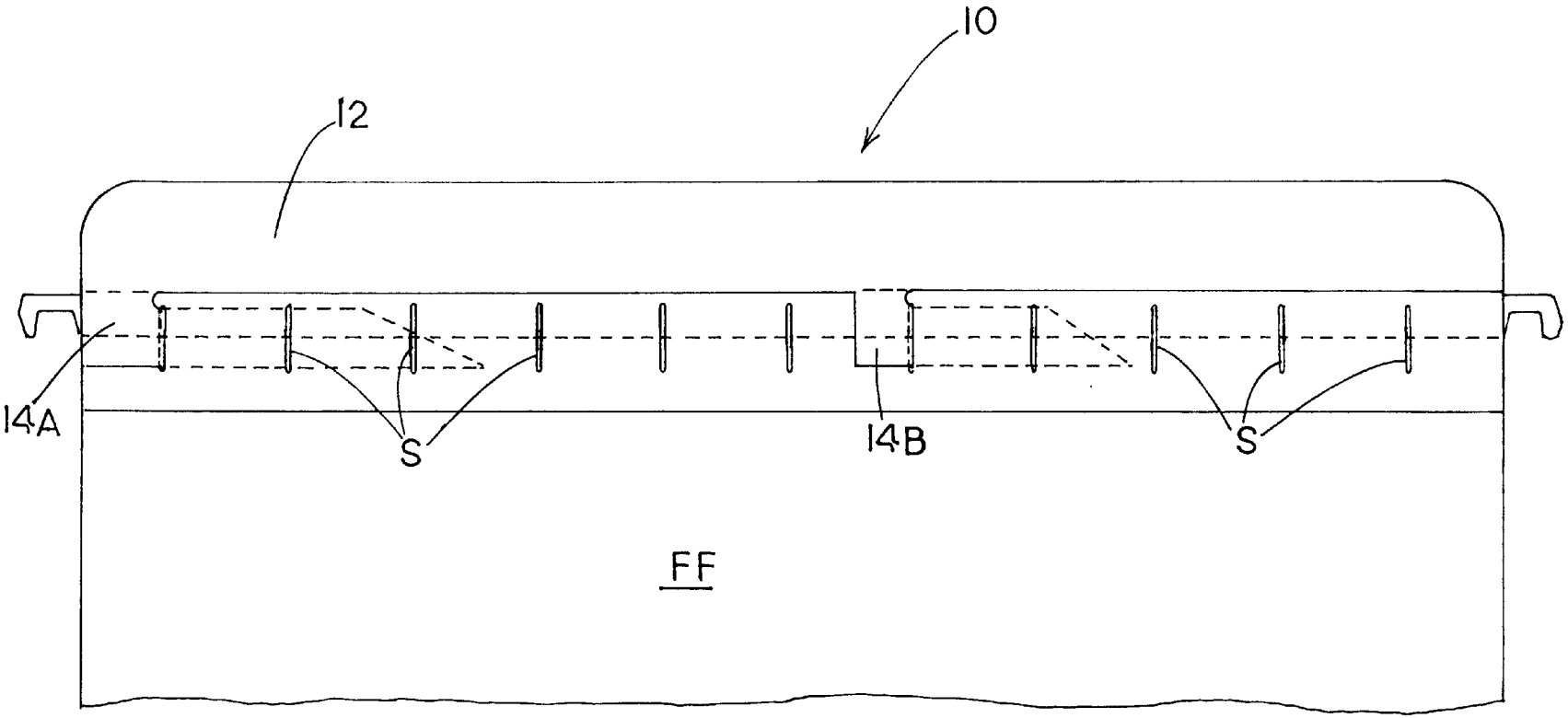
Figure 4D:
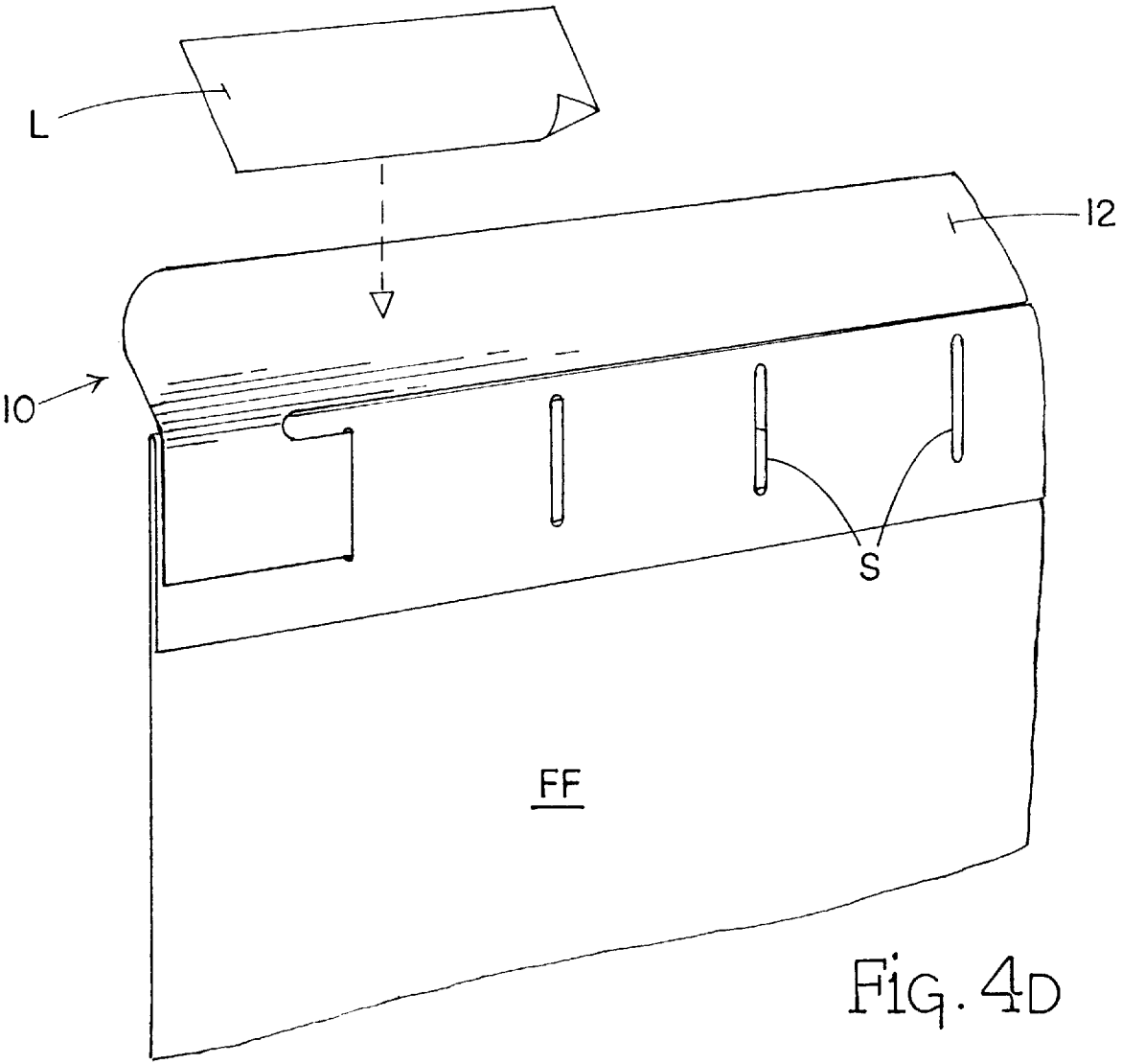
FIG. 4D is a perspective view of the index tab of the present invention assembled with a hanging file folder and wherein an index label is shown about to be affixed to the upper portion of the index tab.

In use, index tab 10 is shown being insertably attached to hanging file folder FF in FIGS. 4A–4C. As seen in FIG. 4A, index tab 10 includes feet 14A and 14B that extend below the top of file folder FF and are sized so as to slide into existing slots S provided along the top of conventional hanging file folder FF. The foot portion of left foot 14A is slightly longer than the foot portion of medial foot 14B. The user places left foot 14A in the first slot to the far left of file folder FF, and the user then slides index tab 10 slightly to the right until the far right edge of right foot 14B is positioned at the first slot S that it meets while being slidably moved to the right. At this point, left foot 14A is already secured under the folded-over, slotted portion of hanging file folder FF. Next, in the same fashion, right foot 14B is inserted by being slid into the first available slot (see FIG. 4B). Finally, entire index tab 10 is pushed to the right until index tab 10 is completely slidably inserted into file folder FF (see FIG. 4C). At this point, index tab 10 will be positioned correctly and substantially even with the left and right edges of hanging file folder FF. If index tab 10 has a top portion 12 of a width less than the width of file folder FF, feet 14A and 14B would be inserted in the same manner described above except that when index tab 10 stops moving right when being slidably urged to the right by the user, tab 10 will be positioned in correct relative location based on the width of top portion 12.

Figure 5:
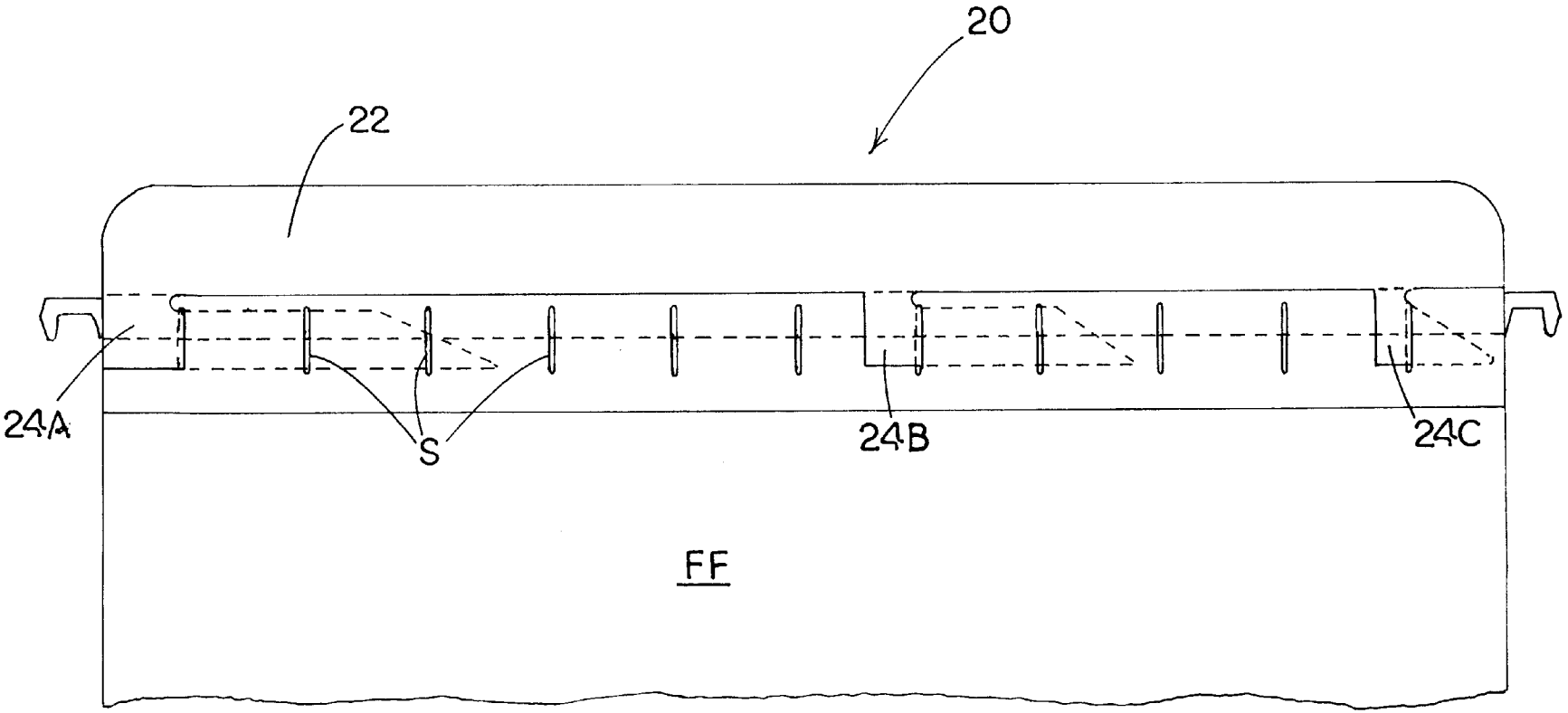
FIG. 5 is a view similar to FIG. 4C but wherein the index tab inserted into the slots of the hanging file folder is the second embodiment as shown in FIG. 2.

FIG. 5 shows index tab 20 fully inserted and appropriately positioned on file folder FF and corresponds to FIG. 4C of index tab 10. Also, FIG. 6 shows index tab 30 in its final position as adhesively affixed to file folder FF. The final placement of index tab 30 shown in FIG. 6 corresponds to the final placement of index tab 20 shown in FIG. 5 and the final placement of index tab 10 shown in FIG. 4C of the drawings. Index tab 40 as shown in FIG. 7 is inherently properly positioned since it is formed with top portion 42 as an integral part of the back wall (or, alternatively, the front wall and/or both walls) of hanging file folder FF.

Although not shown in the drawings, the novel index tabs of the invention can be provided with indentations or tick marks grooved or embossed into the top portion thereof that define a series of vertical lines of varying height. The lines would be used to align various sizes of self-adhesive labels to be applied to the index tab of the invention. For example, a user would produce a label for application to the top portion of an index tab and apply it to the top portion so that the label is aligned with the appropriate tick mark based on the label size. Although a label is not required for use with the novel index tabs of the present invention, applicant believes that most users will indeed wish to write on, computer print or otherwise generate a self-adhesive label for application to the top portion of the index tab.

Although the invention has been described with reference to the preferred embodiments illustrated in the attached drawings, it is noted that equivalents may be employed and substitutions made herein without departing from the scope of the invention as recited in the claims. For example, the invention could be produced such that it could be integrated with other types of existing or future styles of file folders or file guides, by being secured adhesively or otherwise thereto.

It will be understood that various details of the invention may be changed without departing from the scope of the invention. Furthermore, the foregoing description is for the purpose of illustration only, and not for the purpose of limitation—the invention being defined by the claims.

What is claimed is:

1. An index tab for a hanging file folder having a series of spaced-apart slots adjacent a top thereof wherein said index tab is adapted for easy affixation of self-adhesive labels thereto, said index tab comprising:

(a) a tab having a left and right side and comprising a sheet material having an upper portion with a label accepting surface for affixation of a self-adhesive label thereto and a lower portion extending from a bottom edge of said upper portion and adapted to be secured to the hanging file folder, said tab defining a width so as to extend across ⅕ or more of a width of the hanging file folder when it is secured to the hanging file folder;

(b) said upper portion of said tab comprising an elongated strip that is formed so as to extend upwardly and rearwardly relative to the lower portion of said tab whereby said upper portion of said tab will extend upwardly and rearwardly of the hanging file folder for ease of use when secured to the hanging file folder; and (c) said lower portion of said tab comprising a plurality of spaced-apart and laterally extending feet, said feet extending from said bottom edge of said upper portion, wherein each of said feet is adapted to be slidably and laterally inserted into a respective one of the slots of the hanging file folder for securement of said tab thereto, and wherein beginning with a leftmost foot each of said plurality of feet is less wide than a preceding foot, and wherein said tab comprises three feet wherein first foot is located at a left side of said tab, a second foot is located in a medial portion of said tab, and a third foot is located at a right side of said tab;

wherein in use said tab is secured to the hanging file folder and a user then indexes contents by applying the self-adhesive index label thereto.

* * * * *